United States Patent [19]

Kling et al.

[11] Patent Number: 5,001,391

[45] Date of Patent: Mar. 19, 1991

[54] GLOW DISCHARGE STARTER

[75] Inventors: Michael R. Kling, Williamsport; John W. Shaffer, Montoursville, both of Pa.

[73] Assignee: GTE Products Corporation, Danvers, Mass.

[21] Appl. No.: 890,684

[22] Filed: Jul. 30, 1986

[51] Int. Cl.[5] ..... H01J 61/26

[52] U.S. Cl. ..... 313/558; 313/619; 313/549; 313/553; 252/181.1; 252/181.6; 337/27

[58] Field of Search ..... 313/558, 559, 562, 619, 313/637, 643, 622, 633, 55, 61, 549; 337/22, 25, 27; 252/181.1, 181.6

[56] References Cited

U.S. PATENT DOCUMENTS

| | | | |
|---|---|---|---|
| 1,861,643 | 6/1932 | Pirani | 252/181.6 |
| 2,321,910 | 6/1943 | Hays, Jr. | 313/558 X |
| 2,333,710 | 11/1943 | Deimel | 313/54 |
| 2,457,487 | 12/1948 | Peacock et al. | 313/553 |
| 4,360,756 | 11/1982 | Spencer et al. | 313/553 |
| 4,585,716 | 4/1986 | Chalilpoyil et al. | 156/616.1 X |
| 4,646,050 | 2/1987 | Kling et al. | 337/22 X |

*Primary Examiner*—Donald J. Yusko
*Assistant Examiner*—Michael Horabik
*Attorney, Agent, or Firm*—Carlo S. Bessone

[57] ABSTRACT

A glow discharge starter having an hermetically sealed envelope of vitreous material, a seal located at one end thereof and containing an ionizable medium. A pair of electrical conductors extend through the seal and terminate in a spaced relationship to form a pair of electrodes within the envelope. At least one of the electrodes has a bimetallic element secured thereto. The bimetallic element is deformable by heat into engagement with the other of the electrodes. Gettering means contained within the envelope reduces dark effect by improving dark starting and reduces aging time of the glow discharge starter. Preferably, the gettering means is a metal selected from the group consisting of bismuth and lead.

11 Claims, 1 Drawing Sheet

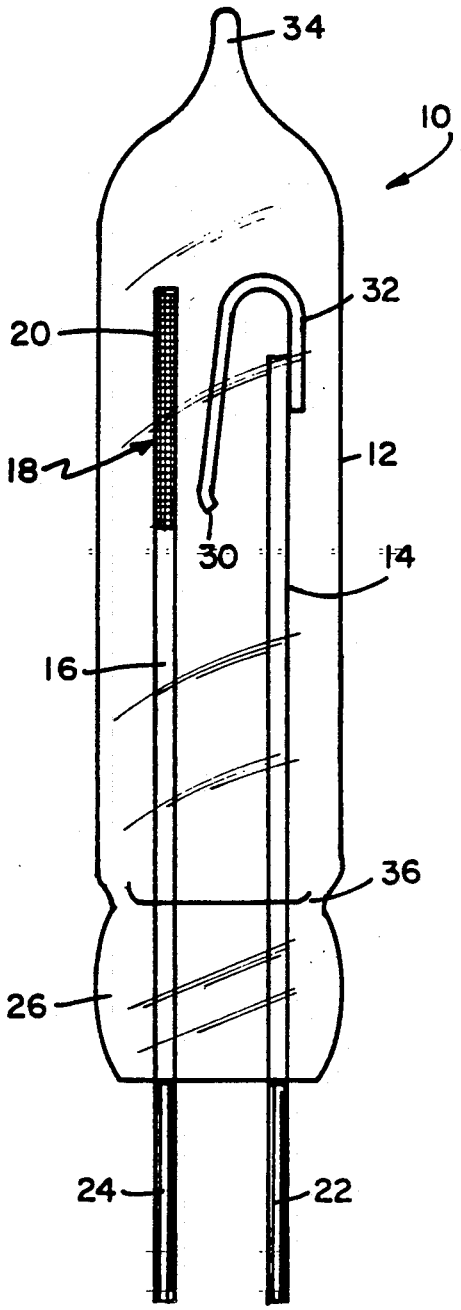
34
10
32
20
18
12
30
14
16
36
26
24
22

GLOW DISCHARGE STARTER

TECHNICAL FIELD

This invention relates in general to glow discharge starters for arc discharge lamps and more particularly to glow discharge starters containing a means for reducing both dark effect and aging time of the glow discharge starter.

BACKGROUND OF THE INVENTION

A glow discharge starter is usually connected across or in parallel with an arc discharge lamp and contains a pair of electrodes. At least one of the electrodes comprises a bimetallic element, which when heated as a result of the glow discharge, bends towards the other electrode, then contact is made the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge starter sequence is repeated until lamp ignition occurs.

A glow discharge starter of the aforementioned type is described, for example, in the book "Light Sources" by Elenbaas, Philips Technical Library, pages 102–103.

Glow discharge starters are subject to an effect commonly known as dark effect, whereby the breakdown voltage of the glow discharge in the starter is higher in the dark than in the light after a period of non-operation. The above-mentioned effect results in delay at starting and erratic operation.

Several methods are known for reducing the dark effect in glow discharge starters. For example. U.S. Pat. No. 2,332,809, which issued to Peters on Oct. 26, 1943, discloses the use of a coating of a conductive material such as aluminum paint on the inner end of the stem and extending onto the lead-in wires at the points where they emerge from the press.

Other methods employing radioactive materials to help minimize or completely eliminate dark effect are also known. For example, U.S. Pat. No. 2,324,907, which issued, to Clack on July 20, 1943 and U.S. Pat. No. 2,740,861 which issued to Lake et al on Apr. 3, 1956, describe the use of a coating of uranium oxide on the inner surface of the end wall of the glass envelope. A still further attempt of U.S. Pat. No. 2,930,872, which issued to Lake on Mar. 29, 1960 teaches the introduction of a minute quantity of radioactive krypton 85 in addition to an impurity gas such as hydrogen, carbon dioxide or nitrogen. U.S. Pat. No. 2,930,873, which issued to Lake et al on Mar. 29, 1960, suggests introducing tritium and a carrier gas consisting of hydrogen into the gaseous filling of the glow discharge starter. Thorium is also used as a radiation source effective in reducing the dark effect of glow discharge starters.

Disadvantages of the above attempts to neutralize the dark effect include, for instance, substantial increases in material and/or manufacturing costs, severe material licensing requirements in the case of the krypton 85. In the case of the aluminum stem paint the effectiveness thereof decreases during the life of the glow discharge starter, thereby rendering the operation of the starter erratic and terminating its useful life.

Glow discharge starters, as manufactured, require a period of burning-in, commonly referred to as aging, before using with an arc discharge lamp in order to stabilize the voltage characteristics of the starter. The stabilization resulting from such a period of aging is believed to be related to the sputter gettering of materials, such as oxygen and water vapor within the glow discharge starter. Sputter cleaning of metal surfaces to promote an oxide-free metal surface for electron emission is also considered to be an important parameter in the aging process. It is highly desirable to have an aging period for the starters as short as possible in order to be compatible with modern high-speed manufacturing equipment.

SUMMARY OF THE INVENTION

It is, therefore, an object of the invention to obviate the disadvantages of the prior art.

It is another object of the invention to provide an alternative means for reducing the dark effect of glow discharge starters.

It is still another object of the invention to provide a means adaptable to automated manufacture thereof.

It is another object of the invention to provide a means for promoting rapid age stabilization of voltage parameters.

These objects are accomplished in one aspect of the invention by the provision of a glow discharge starter comprising an hermetically sealed envelope of vitreous material having a seal located at one end thereof and containing an ionizable medium. A pair of electrical conductors extend through the seal and terminate in a spaced relationship to form a pair of electrodes within the envelope. At least one of the electrodes has a bimetallic element secured thereto. The bimetallic element is deformable by heat into engagement with the other electrode. Gettering means is contained within the envelope for reducing dark effect by improving dark starting and for reducing aging time of the glow discharge starter. Preferably, the gettering means is a metal selected from the group consisting of bismuth and lead.

In accordance with further aspects of the present invention, the gettering means is disposed on a portion of ar least one of the electrodes. Preferably, the gettering means is disposed on the other of the electrodes (i.e., without the bimetal).

BRIEF DESCRIPTION OF THE DRAWING

The sole FIGURE is a front elevational view of an embodiment of a glow discharge starter according to the invention.

BEST MODE FOR CARRYING OUT THE INVENTION

For a better understanding of the present invention, together with other and further objects advantages and capabilities thereof, reference is made to the following disclosure and appended claims taken in conjunction with the above-described drawing.

Referring now to the drawing with greater particularity there is shown in the sole FIGURE a glow discharge starter 10 in accordance with one embodiment of the invention. Glow discharge starter 10 is shown comprising an hermetically sealed envelope 12 containing an ionizable medium of, for example, argon neon, helium and mixtures thereof at a pressure of from about 16 to 20 millimeters of mercury.

Preferably, envelope 12 has a wall thickness in the range of from about 0.015 inch (0.380 millimeter) to less than about 0.025 inch (0.635 millimeter). Envelope 12 can be made from, for example. G-10 lead glass, G-12 lead glass or lime glass. The above-mentioned glasses are available from Corning Glass Works, Corning, New York. A seal 26 (e.g., press seal) is located at one end of envelope 12. An exhaust tip 34 is located at the other end of envelope 12.

A pair of electrical conductors 22 (e.g.. non-segmented) and 24 extend through seal 26 and terminate in a spaced relationship to form a pair of electrodes 14 and 16, respectively within envelope 12. A suitable material for electrical conductors 22 and 24 (and corresponding electrode post 14 and electrode 16) is a nickel-iron alloy, such as Niron 52 available from GTE Precision Materials Group. Warren Pennsylvania. Alternatively, the electrical conductors may consist of a nickel-iron alloy core sheathed in a copper shell. An example of such a material is sold under the trade name "Dumet" and consists of a nickel-iron core having a copper sleeve. The copper sleeve constitutes 21 to 25 percent of the total weight of the material and is usually affixed about the nickel-iron core by swagging, welding, molten dipping, etc. Such wire is especially effective for developing glass-to-metal seals. Generally heat is applied to the glass and to the "Dumet" which, in turn, serves as a bridge between the metal and the glass and insures the desired glass-to-metal seal. Alternatively, electrical conductors 22 and 24 may comprise a nickel-iron alloy core sheathed in a copper shell plated with an electrically conductive material selected from the group consisting of nickel, platinum and rhodium. Specifically, nickel-plated "Dumet" wire having a diameter in the range of from about 0.010 inch (0.254 millimeter) to about 0.025 inch (0.635 millimeter) is preferred because of the relatively low cost as compared with other metal-plated wires.

Electrode 14 has a bimetallic element 32 secured at one end thereof. Bimetallic element 32 is bent over into a U-shape, as shown in the sole FIGURE. so that the free end 30 thereof is proximate electrode 16. Bimetallic element 32 consists of two strips of metal having different linear coefficients of expansion welded together. The side of higher coefficient of expansion is on the inside curve of the U so that bimetallic element 32, when heated by the glow discharge opens and engages electrode 16. A suitable material for bimetallic element 32 is designated as type 2400 and is available from GTE Metal Laminates, 1704 Barnes St., Riedsville, NC 27320. The free end 30 of bimetallic element 32 may be provided with an outwardly projecting embossment or curved portion (not shown) to insure that contact with electrode 16 is always made at the same point after flexure of bimetallic element 32 through a predetermined distance.

Alternatively electrode 16 can be constructed as a second bimetallic electrode (i.e.. have a bimetallic element secured thereto) as shown, for example, in previously mentioned U.S. Pat. No. 2,930,873.

In accordance with the teachings of the present invention a combined gettering means 18 is contained within envelope 12 for reducing dark effect by improving dark starting and for reducing aging time of glow discharge starter 10. Preferably, gettering means 18 is a metal in elemental form selected from the group consisting of bismuth and lead. As shown in the sole FIGURE, gettering means 18 can be in the form of a coating 20 disposed on a portion of electrode 16. Coating 20 is applied by dipping electrode 16 in a molten solution of the desired metal. Alternatively, coating 20 can be applied to electrode 14 or bimetallic element 30. Gettering means 18 can also be in the form of a piece of material welded to electrode 14 or 16.

EXAMPLE I

In a typical but non-limitative example of a glow discharge starter made in accordance with the invention, the envelope 12 was made from G-12 lead glass having a wall thickness of about 0.016 inch (0.406 millimeter) and an outside diameter of approximately 0.175 inch (4.445 millimeters). A pair of nickel-iron alloy (Niron 52) electrical conductors 22, 24 with a diameter of approximately 0.022 inch (0.559 millimeter) extend through a press seal 26 located at one end of the envelope and terminate within the envelope to form a pair of electrodes 14, 16. The substantially parallel electrodes are spaced approximately 0.060 inch (1.524 millimeters) from each other. The distance from exhaust tip 34 to the top 36 of stem press 26 was approximately 0.660 inch (16.764 millimeters). A bimetallic element 32 having a width of approximately 0.062 inch (1.57 millimeters), an overall length approximately 0.320 inch (8.128 millimeters) and a thickness of approximately 0.006 inch (0.152 millimeter) was bent over into a U-shape and welded to electrode 39 within envelope 12. A portion of the other electrode 16 extending approximately 0.150 inch (3.81 millimeters) was coated with approximately 1.0 milligram of metallic bismuth. The envelope 12 contained an ionizable medium of 60 percent argon, 30 percent neon and 10 percent helium at a pressure of approximately 18 millimeters of mercury. The glow discharge starter 10 displaced a volume of approximately 0.25 cubic centimeter.

EXAMPLE II

In another typical but non-limitative example of a glow discharge starter made in accordance with the invention, the envelope 12 was made from G-12 lead glass having a wall thickness of about 0.016 inch (0.406 millimeter) and an outside diameter of approximately 0.175 inch (4.445 millimeters). A pair of nickel-iron alloy (Niron 52) electrical conductors 22, 24 with a diameter of approximately 0.022 inch (0.559 millimeter) extend through a press seal 26 located at one end of the envelope and terminate within the envelope to form a pair of electrodes 14, 16. The substantially parallel electrodes are spaced approximately 0.060 inch (1.524 millimeters) from each other. The distance from exhaust tip 34 to the top 36 of stem press 26 wa approximately 0.660 inch (16.764 millimeters). A bimetallic element 32 having a width of approximately 0.062 inch (1.57 millimeters). an overall length of approximately 0.320 inch (8.128 millimeters) and a thickness of approximately 0.006 inch (0.152 millimeter) was bent over into a U-shape and welded to electrode 39 within envelope 12. A portion of the other electrode 16 extending approximately 0.150 inch (3.81 millimeters) was coated with approximately 1.0 milligram of metallic lead. The envelope 12 contained an ionizable medium of 60 percent argon, 30 percent neon and 10 percent helium at a pressure of approximately 18 millimeters of mercury. The glow discharge starter 10 displaced a volume of approximately 0.25 cubic centimeter.

EXAMPLE II

In an example of a glow discharge starter for use as a control in tests conducted with starters described in Examples I and II. the envelope 12 was made from similar G-12 lead glass having a wall thickness of about 0.016 inch (0.406 millimeter) and an outside diameter of approximately 0.175 inch (4.445 millimeters). The construction of the electrical conductors electrodes, and bimetallic element was similar to those described in Examples I and II. The envelope contained a similar ionizable medium of 60 percent argon, 30 percent neon and 10 percent helium at a pressure of approximately 18 millimeters of mercury. The starter in Example III did not contain an amount of bismuth or lead in accordance with the teachings of the present invention.

Samples of glow discharge starters similar to those described in EXAMPLES I. II and III above were tested for closure of the contacts within the starters within ten seconds or less at a voltage of 170 volts, 60 hertz. The glow discharge starters were aged for five minutes using a 0.35 ampere, 220 volt ballast in series with a 220 volt, 60 hertz supply source. The data obtained appears in TABLE 1.

TABLE I

| EXAMPLE | GETTER | % CLOSURE IN ≦ 10 SECONDS |
|---|---|---|
| I | BISMUTH | 92.5 |
| II | LEAD | 95.2 |
| III | NONE | 38.9 |

TABLE I above shows that after five minutes of aging, glow discharge starters made according to the teachings of the present invention require less aging time.

EXAMPLE IV

In still another typical but non-limitative example of a glow discharge starter made in accordance with the invention the envelope 12 was made from G-!2 lead glass having a wall thickness of about 0.016 inch (0.406 millimeter) and an outside diameter of approximately 0.175 inch (4.445 millimeters). A pair of nickel-iron alloy (Niron 52) electrical conductors 22, 24 with a diameter of approximately 0.022 inch (0.559 millimeter) extend through a press seal 26 located at one end of the envelope and terminate within the envelope to form a pair of electrodes 14, 16. The substantially parallel electrodes are spaced approximately 0.060 inch (1.524 millimeters) from each other. The distance from exhaust tip 34 to the top 36 of stem press 26 was approximately 0.660 inch (16.764 millimeters). A bimetallic element 32 having a width of approximately 0.062 inch (1.57 millimeters). an overall length of approximately 0.320 inch (8.128 millimeters) and a thickness of approximately 0.006 inch (0.152 millimeter) was bent over into a U-shape and welded to electrode 39 within envelope 12. A portion of the other electrode 16 extending approximately 0.150 inch (3.81 millimeters) was coated with approximately 1.0 milligram of metallic bismuth. The envelope 12 contained an ionizable medium of 100 percent argon at a pressure of approximately 20 millimeters of mercury. The glow discharge starter 10 displaced a volume of approximately 0.25 cubic centimeter.

EXAMPLE V

In an example of a glow discharge starter for use as a control in tests conducted with starters described in Example IV, the envelope 12 was made from similar G-12 lead glass having a wall thickness of about 0.016 inch (0.406 millimeter) and an outside diameter of approximately 0.175 inch (4.445 millimeters). The construction of the electrical conductors, electrodes, and bimetallic element were similar to those described in Example IV. The envelope contained an ionizable medium of 100 percent argon at a pressure of approximately 20 millimeters of mercury. The starter in Example V did not contain an amount of bismuth or lead in accordance with the teachings of the present invention.

Samples of glow discharge starters similar to those described in EXAMPLES IV and V above were tested for closure of the contacts within the starters within ten seconds or less at a voltage of 170 volts, 60 hertz. The glow discharge starters were aged from one to four minutes using a 0.35 ampere, 220 volt ballast in series with a 220 volt, 60 hertz supply source. The data obtained appears in TABLE II.

TABLE II

| AGING TIME (MINUTES) | % CLOSURE IN ≦ 10 SECONDS | |
|---|---|---|
| | EXAMPLE IV | EXAMPLE V |
| 1 | 58.3 | 0 |
| 2 | 79.8 | 50.0 |
| 3 | 100.0 | 54.2 |
| 4 | 100.0 | 95.8 |

TABLE II above shows the more rapid aging and stabilization of the glow discharge starters made in accordance with the teachings of the present invention. Following a further period of aging at 170 volts, 60 hertz at 0.35 ampere, the glow discharge starters of EXAMPLES IV and V were placed in an enclosure and allowed to soak in the total dark environment for 20 seconds, TABLE III shows the ability of the glow discharge starters to start in total darkness within 10 seconds or less at 180 volts.

TABLE III

| EXAMPLE | GETTER | % STARTING IN DARKNESS |
|---|---|---|
| IV | BISMUTH | 100.0 |
| V | NONE | 79.2 |

TABLE III above shows the improvement in the reduction in rhe dark effect of glow discharge starters made in accordance with the teachings of the present invention.

While there have been shown and described what are at present considered to be the preferred embodiments of the invention, it will be apparent to those skilled in the art that various changes and modifications can be made herein without departing from the scope of the invention as defined by the appended claims.

We claim:

1. A glow discharge starter comprising:

an hermetically sealed envelope of vitreous material having a seal located at one end thereof and containing an ionizable medium:

a pair of electrical conductors extending through said seal and terminating in a spaced relationship to form a pair of electrodes within said envelope, at least one of said electrodes having a bimetallic element secured thereto, said bimetallic element being deformable by heat into engagement with the other of said electrodes; and gettering means contained within said envelope for reducing dark effect by improving dark starting and for reducing aging time of said glow discharge starter, said gettering means being a metal selected from the group consisting of bismuth and lead.

2. The glow discharge carrier of claim 1 wherein said gettering means is a coating disposed on a portion of at least one of said electrodes.

3. The glow discharge starter of claim 1 wherein said gettering means is a coating disposed on a portion of said other of said electrodes.

4. The glow discharge starter of claim 1 wherein the weight of said gettering means is approximately 1.0 milligram.

5. The glow discharge starter of claim 1 wherein said envelope has a wall thickness in the range of from about 0.015 inch to less than about 0.025 inch.

6. The glow discharge starter of claim 1 wherein said envelope has an outside diameter of approximately 0.175 inch.

7. The glow discharge starter of claim 1 wherein said envelope is glass.

8. The glow discharge starter of claim 1 wherein said glow discharge starter displaces a volume of approximately 0.25 centimeter.

9. The glow discharge starter of claim 1 wherein said ionizable medium comprises a mixture of argon, neon and helium.

10. The glow discharge starter of claim 1 wherein said ionizable medium comprises a mixture of approximately 60 percent argon, 30 percent neon and 10 percent helium.

11. The glow discharge starter of claim 10 wherein said mixture is at a pressure of approximately 18 torr.

* * * * *